US005359817A

United States Patent [19]

Fulton

[11] Patent Number: 5,359,817

[45] Date of Patent: Nov. 1, 1994

[54] ARCHITECTURAL MOLDINGS OF RIGID THERMOSET POLYMER BASED MATERIAL

[75] Inventor: Fred D. Fulton, Chico, Calif.

[73] Assignee: Transfer Flow International, Inc., Chico, Calif.

[21] Appl. No.: 50,978

[22] Filed: Apr. 19, 1993

Related U.S. Application Data

[63] Continuation of Ser. No. 656,808, Feb. 19, 1991, abandoned.

[51] Int. Cl.[5] ..... E04F 19/04

[52] U.S. Cl. ..... 52/288.1; 52/716.1; 52/718.03; 52/717.05

[58] Field of Search ..... 52/287, 288, 289, 296, 52/716.1, 718.07, 718.04, 718.06, 718.03, 511, 718.05; 403/231, 295, 402

[56] References Cited

U.S. PATENT DOCUMENTS

| | | | |
|---|---|---|---|
| 2,217,574 | 10/1940 | Tinnerman | 52/718.06 |
| 3,298,147 | 1/1967 | Haberman | 52/287 |
| 3,302,350 | 2/1967 | Brown et al. | 52/287 |
| 3,746,378 | 7/1973 | Meyer | 52/717.1 X |
| 3,843,475 | 10/1974 | Kent | 52/717.1 X |
| 3,847,865 | 11/1974 | Duggins | 524/137 |
| 4,258,515 | 3/1981 | Owen | 52/288 X |
| 4,296,583 | 10/1981 | Egenlauf | 52/287 X |
| 4,808,451 | 2/1989 | McCue et al. | 52/717.1 X |
| 4,856,253 | 8/1989 | Jou | 52/287 |
| 4,899,513 | 2/1990 | Morris | 52/511 |
| 4,905,438 | 3/1990 | Brennan | 52/287 |
| 4,911,971 | 3/1990 | McCue et al. | 52/717.1 X |
| 5,001,877 | 3/1991 | Edwards | 52/287 |
| 5,179,811 | 1/1993 | Walker et al. | 52/718.02 |

*Primary Examiner*—Carl D. Friedman
*Assistant Examiner*—Kien Nguyen

[57] ABSTRACT

Trim moldings such as crown molding, chair rail molding, base molding and door casing for a building. The trim moldings are made of substantially acrylic or polyester rigid thermoset polymer components. The trim moldings may be manufactured to realistically visually simulate moldings made of natural stone. A method of manufacture of the moldings may utilizes bulk slabs or blocks of rigid thermoset polymer based materials which are then properly shaped for use as a building trim molding with mechanical material removal methods such as sawing, cutting, sanding, and polishing to achieve the desired size, shape and appearance of molding. The thermoset polymer based moldings are structured with grooves in the backside, with the grooves sized and positioned to snap onto spring biased members of mounting fixtures attached to the building for a removable attachment of the moldings.

10 Claims, 10 Drawing Sheets

ARCHITECTURAL MOLDINGS OF RIGID THERMOSET POLYMER BASED MATERIAL

This is a continuation of Ser. No. 07/656,808, filed Feb. 19, 1991now abandoned.

BACKGROUND OF THE INVENTION

1. Field of the Invention

This invention relates to decorative and functional trim moldings for buildings. The invention includes the use of rigid thermoset polymer based material and a method of manufacture to shape the moldings. The invention additionally includes a snap-attach method of affixing the moldings to a building.

2. Description of the Prior Art

Materials utilized in the past to form building trim moldings include wood, marble and other stone, plastics, and metal, all of which have various disadvantages. Wood may warp or split, and may need refinishing on a regular basis. Furthermore, the finished appearance of wood is somewhat limited in that multiple color patterns which realistically simulate desirable stone or marble patterns are difficult if not impossible.

Some thermoplastics used to form moldings are U.V. light sensitive and tend to fade in color, while others give off toxic fumes when burned, which could prove a health hazard during a building fire. Also, like wood, the finished appearance of thermoplastic is somewhat limited in that multiple color patterns which realistically simulate desirable stone or marble patterns are difficult if not impossible whether injection or extrusion molding is used as the method of shaping the thermoplastic into a molding. An example of a molding manufactured of extruded plastic which includes plastic injection molded accessories is described in U.S. Pat. No. 3,707,061 issued to H. J. Collette et al on Dec. 26, 1972. The Collette et al molding is attachable to a building by way of spring biased brackets and cooperative structuring on the backside of the molding which snaps into the brackets.

I have also seen moldings for sale in the market which appear to be manufactured of foamed extruded plastic. These moldings have a porus or open cell structure in the interior, and a closed or "skinned" outer surface, which would be typical of a foamed product which was extruded through a shaping die while the material was still soft. These foamed extruded plastic moldings all appear to be coated with an outer finish such as paint, or more commonly a wrapping of paper or vinyl printed to appear as wood.

One problem associated with coated or wrapped moldings such as covered wood, or cover plastic moldings lies in that if the coating or wrapping is scratched, nicked or otherwise damaged, the substrate shows through, and is typically fairly unsightly, being a different color than the coating material. Furthermore, if the coating is paint, sometimes the paint adjacent the damaged area has faded with age, and the entire molding may need to be repainted. If a paper or vinyl wrapped molding is damaged in a spot, I am not aware of any suitable method of repairing the damage short of replacing the entire molding strip.

Moldings made of metal can dent quite easily if made of thin sheet metal, which is typically the case, and the dents are relatively difficult to remove. Additionally, a bare or brushed metal finish is also not considered very aesthetically pleasing in residences, having a rather industrial appearance. If the metal moldings are painted, typically a scratched or otherwise damaged area shows the substrate of a different color. Metal moldings, like wood moldings are somewhat limited in appearance, in that multiple color patterns which realistically simulate stone or marble patterns are difficult if not impossible. An example of a trim molding made of metal is described in U.S. Pat. No. 3,107,759 issued to R. L. Day et al on Oct. 22, 1963. The Day et al patent shows snap-on attachable metal moldings for use around a door.

Although marble, granite, and other stone products are desirable for reasons such as durability and the availability of a wide variety of colors and color patterns which generally never need refinishing, natural stone products are very often cost prohibitive for those who would otherwise utilizes building materials made of stone. Another drawback of stone in some applications is that it is quite heavy, often requiring a rather substantial and costly support structure for secure installation.

A further disadvantage of the aforementioned types of materials from which moldings have been manufactured, is that it is difficult to predictably guarantee coordination of the texture, and more importantly the color with other structures such as wainscoting or countertops when these structures are made of a different material. It is fairly widely accepted that the best way to color match two items, is to either make both items of the same material and color mix, or to coat both items with the same material and color of outer covering. Furthermore, it is generally accepted the best way to coordinate or match texture between two or more items is to manufacture the items out of the same materials.

In many situations, the ability to precisely match texture and or color is seen to be very important by many interior decorators for aesthetic reasons. A current trend in the designing of kitchens, bathrooms, hallways, and offices of both residences and commercial buildings has resulted in the widening use of non-foamed, non-laminated polymer based thermoset materials for countertops and wainscoting. These rigid, solid, polymer based thermoset materials are often referred to by the general public as cultured marble, and by the related manufacturing industry as "solid surface products", or "solid surfacing materials". These synthetic polymer based solid surfacing materials are manufactured substantially of thermosetting polyester or acrylic resins depending on the manufacturer, and usually contain small percentages of other components both natural and synthetic to form desired color, pattern designs, and other desirable physical and visual characteristics in the plastic.

Polymer based solid surfacing materials are available from several U.S. manufacturers such as E. I. duPont de Nemours & Co., Inc. of Wilmington, Del. 19898 U.S.A., who market their polymer based solid surfacing products under the trademark of "Corian". "Corian" is a trademark of Du Pont which refers to their solid surfacing polymer based material. "Corian" is a substantially rigid, non-foamed, non-laminated or coated solid surfacing material homogeneously composed primarily of thermoset acrylic components. "Corian" is considered to be a "thermoset" acrylic product, however, unlike most other thermoset polymer based solid surfacing materials, "Corian" does possess the quality of being thermoformable to a degree, a quality typically reserved to thermoplastics rather than thermoset plastic.

Another manufacturer of polymer based solid surfacing materials is the Nevamar Corporation located at 8339 Telegraph Rd., Odenton, Md. 21113 U.S.A. The Nevamar Corporation markets their solid surfacing material under the trademark of "Fountainhead". "Fountainhead" is a substantially rigid, non-foamed, non-laminated or coated solid surfacing material homogeneously composed of a thermoset polymer alloy comprised mostly of polyester components having therein a small percentage of acrylic components.

Another manufacturer of polymer based solid surfacing materials is the Formica Corporation, located at 155-T Rte. 46, W., CN-980, Wayne, N.J. 07470 U.S.A. The Formica Corporation sells their solid surfacing material under the trademark name of "Surell". "Surell", like "Corian" and "Fountainhead", is a dense thermoset plastic. "Surell" is a substantially rigid, non-foamed, non-laminated or coated solid surfacing material homogeneously composed substantially of polyester components.

Du Pont, the Nevamar Corporation, and the Formica Corporation, and several other companies not specifically mentioned, who produce very similar polymer solid surfacing products, manufacture and sell polymer based solid surfacing materials in sheet form useful for walling or countertops, and preformed shapes made of the same polymer based materials useful as kitchen and bathroom lavatories. The polymer based sheets are typically available in ¼" through ¾" thicknesses, and can be cut to size or otherwise shaped with available mechanical material removal methods using sawing and shaping tools such as router bits, power saws and shapers, and the like.

Some of the recognized advantages of using polymer based solid surfacing materials such as "Corian", "Fountainhead" or "Surell" over other available materials such as wood, metal, and polymer based laminates for countertops and walling, lies in the fact that the material is a solid, polymeric non-laminated structure which the color or decorative patterns extend completely therethrough. Furthermore, solid polymer based materials have a high tensile strength, are quite hard and dense, and are highly resistant to chipping, cracking, warping, burning, staining, and do not give off toxic fumes in a fire, all of which cannot be said about many other materials which could be used as substitutes therefore. If polymer based solid surfacing material does become stained, burned or scratched so deeply that the damage cannot be removed with a common household abrasive cleanser, the damage can be readily removed by light sanding with steel wool or fine sand paper, this due to the fact that the material is solid, and the color or visual patterns extends completely therethrough.

Other attractive qualities associated with polymer based solid surfacing materials such as "Corian", "Surell" or "Fountainhead" include ease of boring holes therein without the splitting often associated with wood, ease of adhesive bonding with available glues and color matched sealants, ease of shaping without chipping and splintering, and ease of cleaning.

Additionally, thermoset polymer based solid surfacing materials such as "Corian", "Surell" or "Fountainhead" may be manufactured at a much lower price to very closely physically feel and visually realistically simulate marble, granite, and other natural stone products which have long been used as building materials due to recognition of the durability and beauty of such natural substances. Furthermore, thermoset polymer based solid surfacing materials are significantly more "workable" as opposed to shaping and cutting stone.

SUMMARY OF THE INVENTION

The invention of this disclosure includes architectural moldings made of rigid thermoset polymer based materials, so as to provide the above described material advantages of polymer based solid surfacing materials in a building trim molding. Additionally proposed herein is a method of making and attaching the moldings. The types of moldings this disclosure is primarily directed toward, but not limited to, include interior moldings such as base moldings installed at the joint between a wall and a floor; chair rail moldings typically installed extending horizontally along a wall about three feet off of the floor; crown moldings installed at the joint between a wall and a ceiling; and door casing molding typically installed to cover the crack or joint between a door jam and the adjacent finished wall of a building.

With my invention, when thermoset polymer based solid surfacing materials such as "Corian", "Fountainhead" or "Surell" are utilized as a desk top, countertop surface, or walling surface in a room, matching moldings may also be utilized in the same material to provide a particulary well coordinated decorative scheme. The utilization of thermoset polymer based solid surfacing materials for moldings, opens up a whole new field of interior decorating possibilities. Thermoset polymer based solid surfacing materials can be produced in a wide variety of colors with various multi-color combinations available which realistically simulate the appearance and feel of marble and other natural stone products. Thermoset polymer based solid surfacing materials provide predictable colors and patterns which currently allow all pieces such as countertops and wallings to be texture and or color matched nearly exactly and consistently, which is very difficult even with real stone products, since stone will vary widely in color even when from the same quarry. With my invention, the trim moldings used in a room may be texture and or color matched nearly exactly and consistently with nearby countertops or walls surfaced with thermoset polymer based solid surfacing materials such as "Corian", "Fountainhead" or "Surell" for example. Additionally, the trim moldings may be manufactured to so realistically visually simulate moldings made of natural stone, that the vast majority of people will believe the molding is made of stone even after closely scrutinizing the product, and this at a lower cost of manufacturing than stone moldings. It should be noted that available thermoset polymer based solid surfacing materials such as "Corian", "Fountainhead" or "Surell" are not always manufactured to visually simulate stone, often being manufactured in solid colors or color patterns not intended to appear as stone at all.

In using my thermoset polymer based moldings, in order to avoid having to pre-drill holes for nails to fasten the molding to the building, my moldings are structured to be used in combination with a snap-on attachment structure using grooves and spring biased fixtures. This snap-on attachment method eliminates the filling of nail holes with a filler, which otherwise would have to be carefully color matched, and due to normal shrinkage in fillers, usually would need to be applied twice.

Additionally, since the typical thermosetting chemical compositions which make-up solid surfacing materials are not suitably extrudable or injection moldable to feasibly form desired molding shapes with certain color patterns, I propose a method of manufacture of the moldings which utilizes pre-manufactured bulk slabs or blocks of rigid polymer based solid surfacing materials selected of the desired color, and shaping the bulk materials by way of mechanical material removal methods such as sawing, cutting, sanding, polishing and the like to achieve the desired size, shape and appearance of molding.

Therefore, one major object of my invention is to provide improved architectural moldings for a building comprised of rigid thermoset polymer based solid surfacing materials which may be utilized to nearly exactly match the texture and or color or color patterns of nearby items also manufactured of thermoset polymer based solid surfacing materials.

A further object of my invention is to provide the above in combination with a releasable snap-on attachment structure and method of affixing the molding in place.

A further object of my invention is to provide the above and a feasible method of manufacturing the moldings.

A further object of my invention is to provide the above wherein the moldings may be manufactured to visually simulate moldings made of natural stone, and generally at a lower manufacturing cost than molding made of real stone.

Other objects and advantages of my invention will be better understood upon reference to the following detailed description when read in conjunction with an examination of the accompanying drawings.

BEST MODE OF CARRYING OUT THE INVENTION

Figure 1:
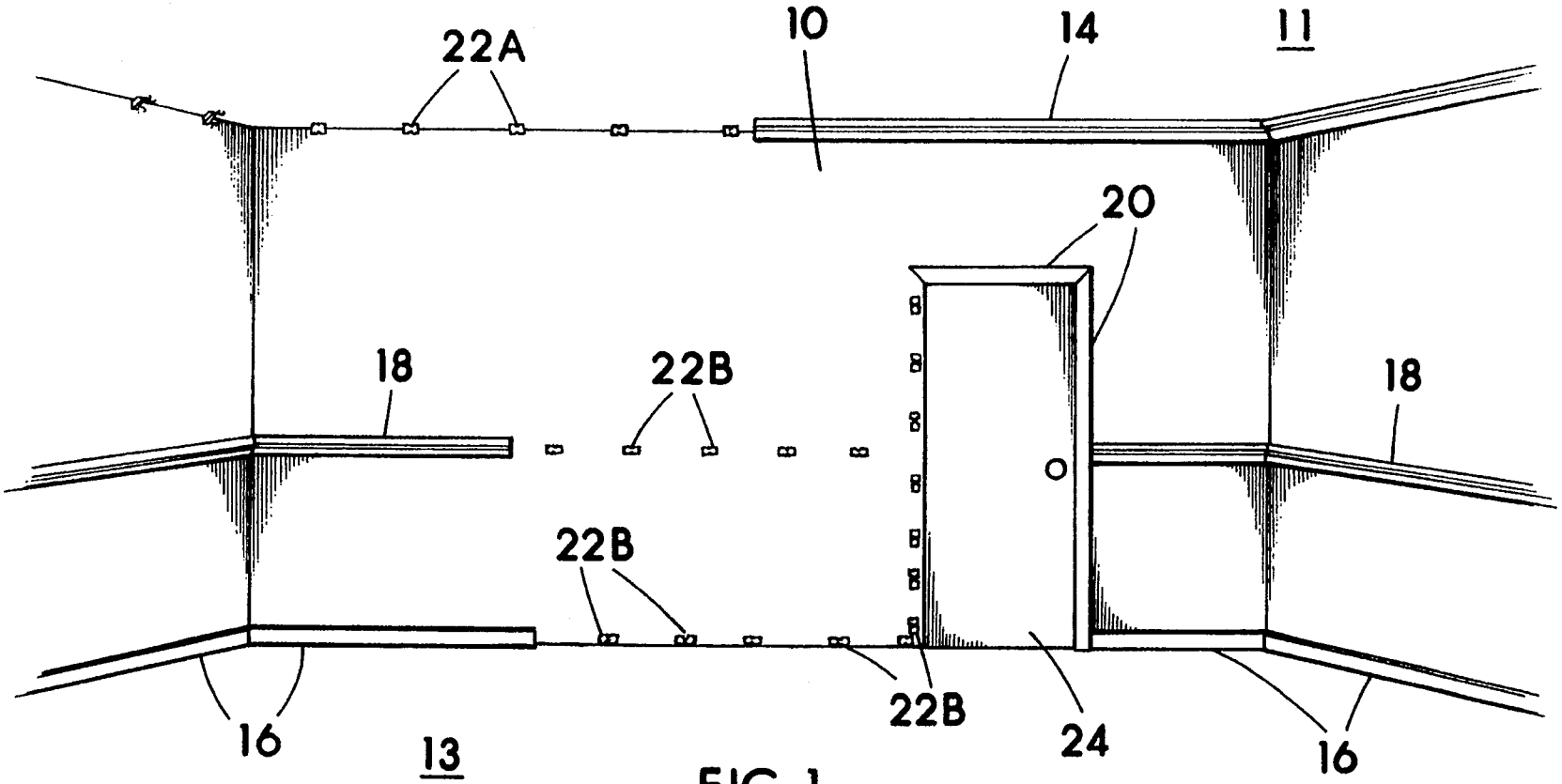
FIG. 1 depicts a room wherein various anticipated moldings made in accordance with the immediate invention are utilized. Some sections of the molding have not yet been installed over the aligned spring biased fixtures attached to the building structure.

Referring to the drawings where the elongated trim moldings made and structured in accordance with the immediate invention are designated generally by 12, being any of the moldings, and specific trim moldings are designated with individual numbers. In FIG. 1, a portion of a room having a wall 10, a ceiling 11, a floor 13, and a door 24 are shown to exemplify proposed in-use placement of the trim moldings made in accordance with the immediate invention. Trim molding shown in the room include crown molding 14 attached at the joint between wall 10 and ceiling 11, base molding 16 attached at the joint between wall 10 and floor 13, chair rail molding attached to wall 10 and extending horizontally, and door casing 20 covering the crack or joint between the frame of door 24 and wall 10. Some sections of the molding 12 have not yet been installed over the aligned spring biased fixtures 22 A and 22 B attached to the wall 10.

Figure 2:
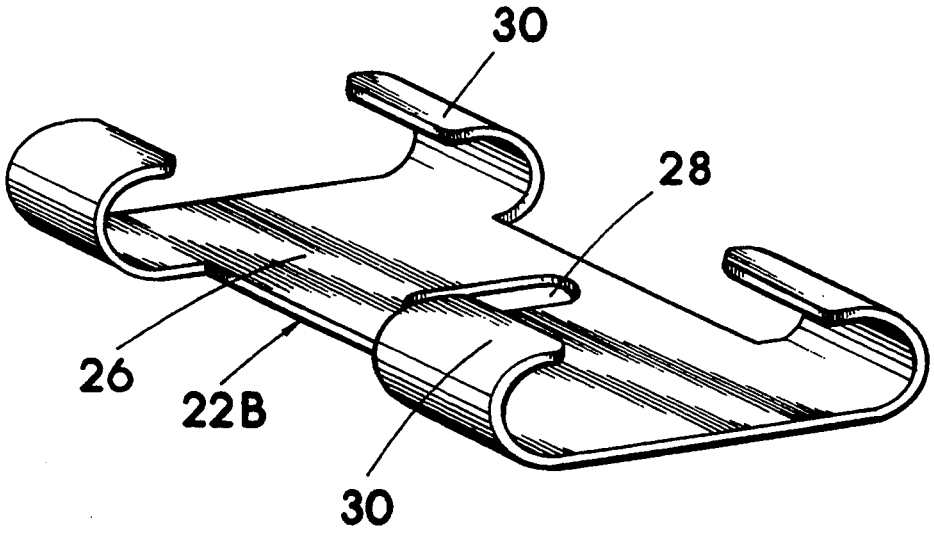
FIG. 2 is an example of one anticipated spring biased fixture which may be used as part of the immediate invention.
Figure 3:
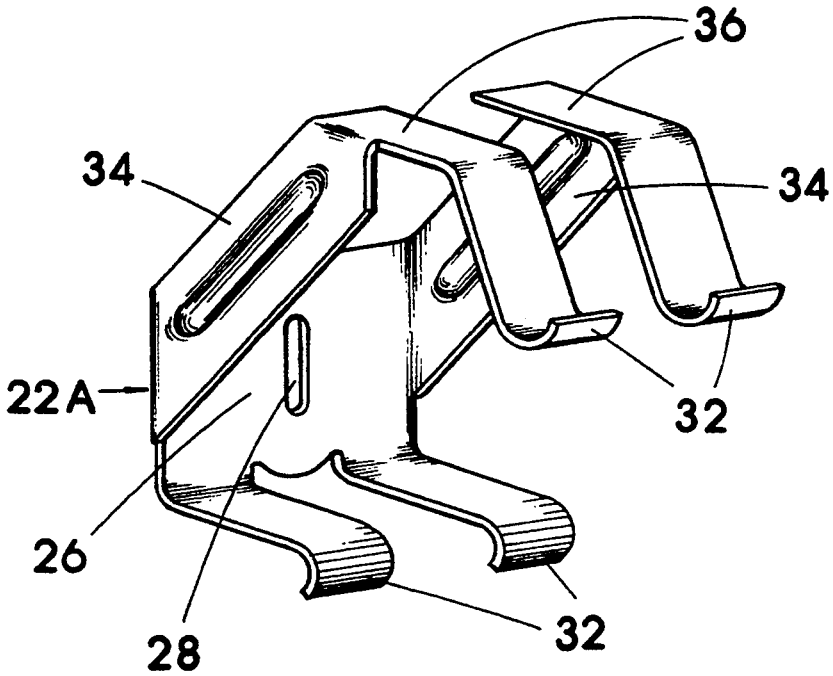
FIG. 3 is an example of another anticipated spring biased fixture which may be used as part of the immediate invention.
Figure 9:
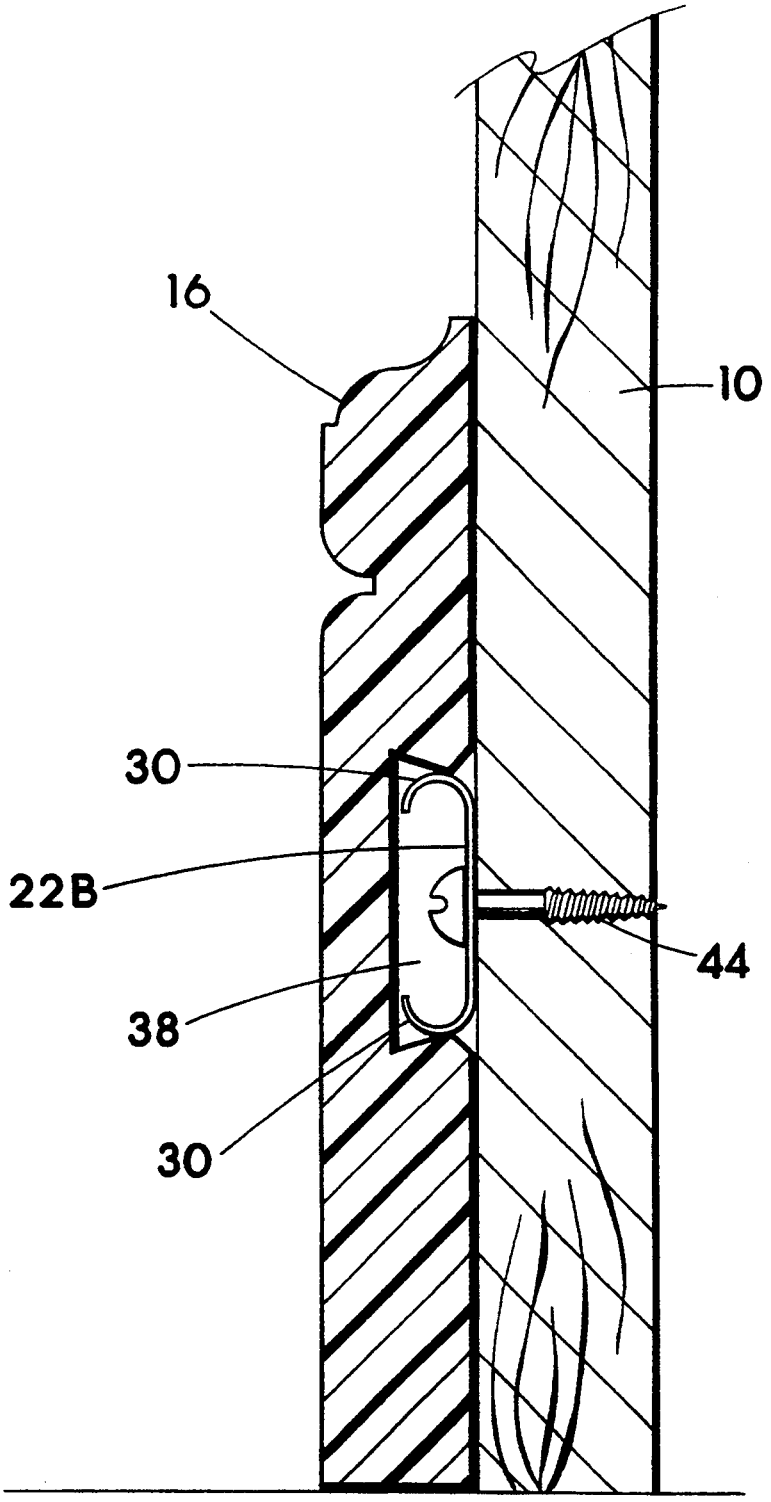
FIG. 9 is a sectional end view of a portion of a wall and base molding attached in accordance with the immediate invention.

Moldings 12 are attached to the building structure using cooperative snap together structuring, a groove component of which is formed in the back surface of the moldings 12, and the other component is in the form of a bracket or fixture. FIGS. 2 and 3 illustrate two various preferred fixtures which may be includes as part of the immediate invention. Fixture 22 B is shown in a perspective view in FIG. 2, and in a straight line spaced apart alignment of a plurality of fixture 22 B in FIG. 1 attached to wall 10. Fixture 22 B may be made of a single piece metal or plastic, and is comprised of a generally flat rigid mounting or base plate 26 and four generally identical inwardly curved and slightly flexible spring biased tabs 30. Base plate 26 has an elongated aperture 28 in the approximate center to allow attaching fixture 22 B to a surface with a fastener such as a screw 44 or a toggle bolt or other suitable faster, with the elongation allowing a degree of adjustability in the exact placement of the fixture after the screw 44 has been started. When attached to a wall or other structure of a building, the back surface of fixture 22 B is placed flat against the building structure with spring biased tabs 30 extending outward so as to be able to be snapped into a dovetail shaped groove 38 in the back of molding 12, which may be better ascertain from examining FIG. 4 where the back surface of base molding 16 is shown with two fixture 22 B positioned to be received in groove 38, and by examining FIG. 9 where a fixture 22 B is snapped into a dovetail shaped groove 38.

Figure 5:
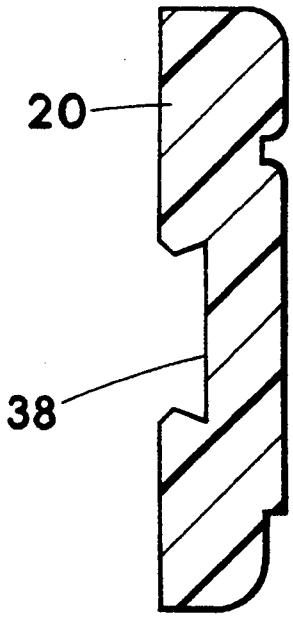
FIG. 5 is a sectional end view of one anticipated molding made in accordance with the immediate invention.
Figure 6:
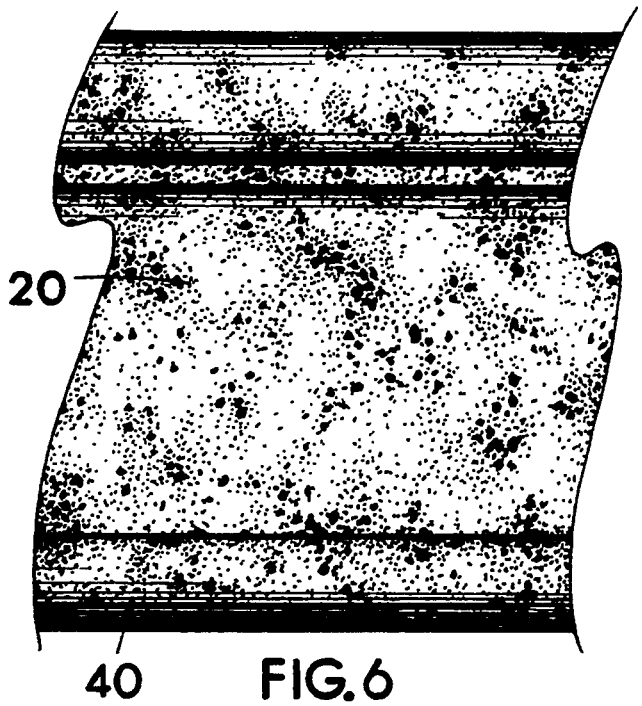
FIG. 6 is a frontal view of a portion of the molding of FIG. 5 showing the molding appearing as granite or similar stone.
Figure 7:
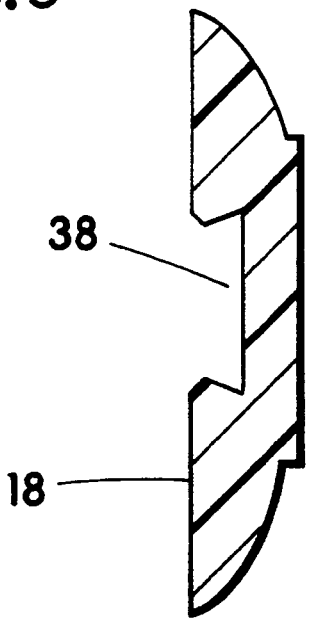
FIG. 7 is a sectional end view of another anticipated molding made in accordance with the immediate invention.
Figure 8:
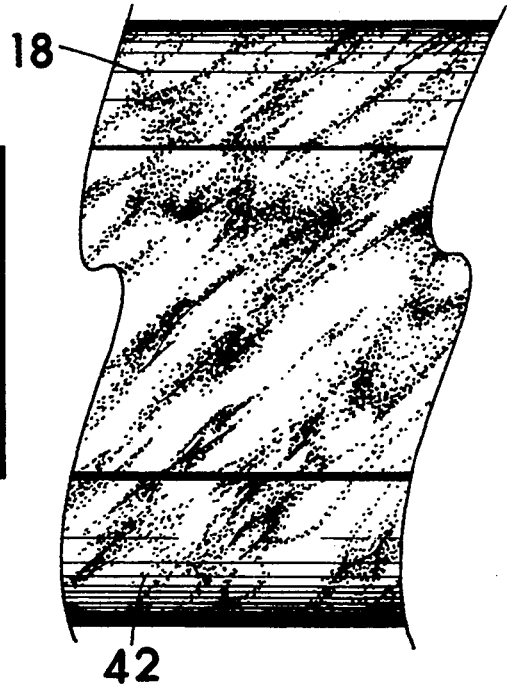
FIG. 8 is a frontal view of a portion of the molding of FIG. 7 showing the molding appearing as marble or similar stone having marbling.

Referring now to FIG. 5 where a sectional end view is shown of door casing 20 having a dovetail shaped groove 38 in the back surface, and an ornamental shape on the front surface or oppositely disposed surface from dovetail groove 38. FIG. 6 is a frontal view of a portion of the molding 20 of FIG. 5 showing the molding appearing as granite or similar course-grained stone. FIG. 7 is a sectional end view of another anticipated molding made in accordance with the immediate invention. The molding of FIG. 7 is chair rail molding 18, and also contains a dovetail shaped groove 38 in the back surface thereof. The front surface of the chair rail molding 18 is shaped somewhat differently than that of door casing 28, although a wide variety of decorative front shapes are possible with any of the moldings 12 of this disclosure. FIG. 8 is a frontal view of a portion of the molding of FIG. 7 showing the molding appearing as marble or similar stone having marbling. It should be noted any of the moldings 12 of this disclosure may be made to appear as stone as those shown in FIG. 6 and 8, or may be made in a solid color or a pattern of color not intended to appear as stone.

Figure 4:
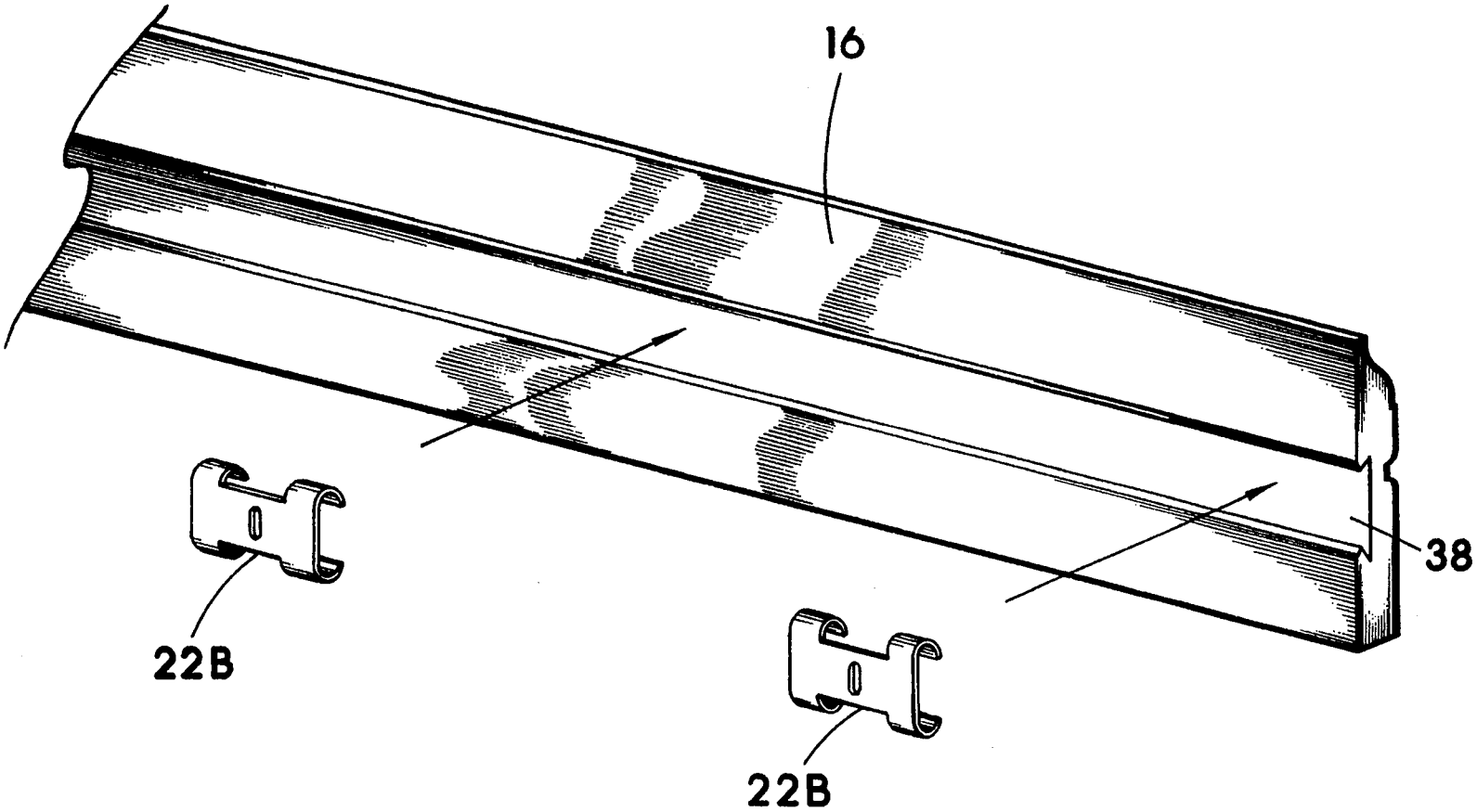
FIG. 4 depicts the backside of a molding made in accordance with the immediate invention, and two spring biased fixtures.

Of my moldings 12 which utilize the dovetail shaped groove 38, the groove 38 would normally extend lengthwise the full length of the molding, and generally in the center of the back surface of the molding as may be better understood from FIG. 4 where the back surface of base mold 16 is shown. Additionally, as may be seen in FIG. 9, the narrow portion of the dovetail shaped groove 38 is positioned at the back surface of the molding, with the wider portion of groove 38 more toward the interior lengthwise center of the molding. The positioning of groove 38 provides a narrow open mouth slightly narrower than the width across two oppositely disposed spring biased tabs 30 of fixture 22 B. Fixtures 22 B are first attached in spaced alignment to a wall, and molding 12 having a dovetail groove 38 may be snapped over the properly aligned plurality of fixture 22 B. Tabs 30 of fixtures 22 B are inwardly curved so as to present smooth surfaces which abut the material defining the narrow opening of groove 38 during the snapping on process. The curved portion of tabs 30 abutting the material defining the narrow opening of groove 38 is such that the tabs 30 will bend inward toward the center of the fixture when pressure is applied against the molding 12. The bending inward of tabs 30 allows the molding 12 to move over the fixtures 22 B, or in other words for the fixture 22 B to snap into groove 38 where spring tension of the tabs 30 attempting to move back outward into a relaxed position apply sufficient pressure. against the material defining the narrow opening of groove 38 to hold the molding 12 securely in place. All four tabs 30 of each fixture 22 B are locked within groove 38 when properly installed. The molding 12 may be removed if desired by simply applying sufficient pulling pressure on molding 12 to defeat the holding pressure of tabs 30, although a prying device such as a pry bar or screw driver is usually needed to move the molding 12 away from the wall sufficiently to grasp the molding to remove it completely from the wall and fixtures 22 B.

Fixture 22 A is shown in a perspective view in FIG. 3 and in a straight line spaced apart alignment of a plurality of fixture 22 A in FIG. 1 attached to wall 10. Fixture 22 A may be made of a single piece metal or plastic, and is comprised of a generally flat rigid mounting or base plate 26 and four generally identical outwardly curved spring biased tabs 32. Base plate 26 of fixture 22 A also has an elongated aperture 28 in the approximate center to allow the attaching of the fixture 22 A to a surface with a fastener such as a screw 44. As shown in FIG. 3, the top or upper most spring biased tabs 32 are attached to base plate 26 by two angling side members 34. Additionally, two flat surfaces 36 are provide as a part of fixture 22 A. Flat surfaces 36 are portions of fixture 22 A lying between the top tabs 32 and side member 34. Flat surfaces 36 are each placed lying flat in the same plane, and in a plane substantially 90 degree to the back surface of base plate 26 as may best be ascertained from FIG. 10. The flat 90 degree relationship between the back surface of base plate 26 and flat surfaces 36 allow fixture 22 A to be quickly properly positioned in a corner defined by intersecting planes of a wall 10 and a ceiling 11 prior to attaching with a screw 44.

Figure 10:
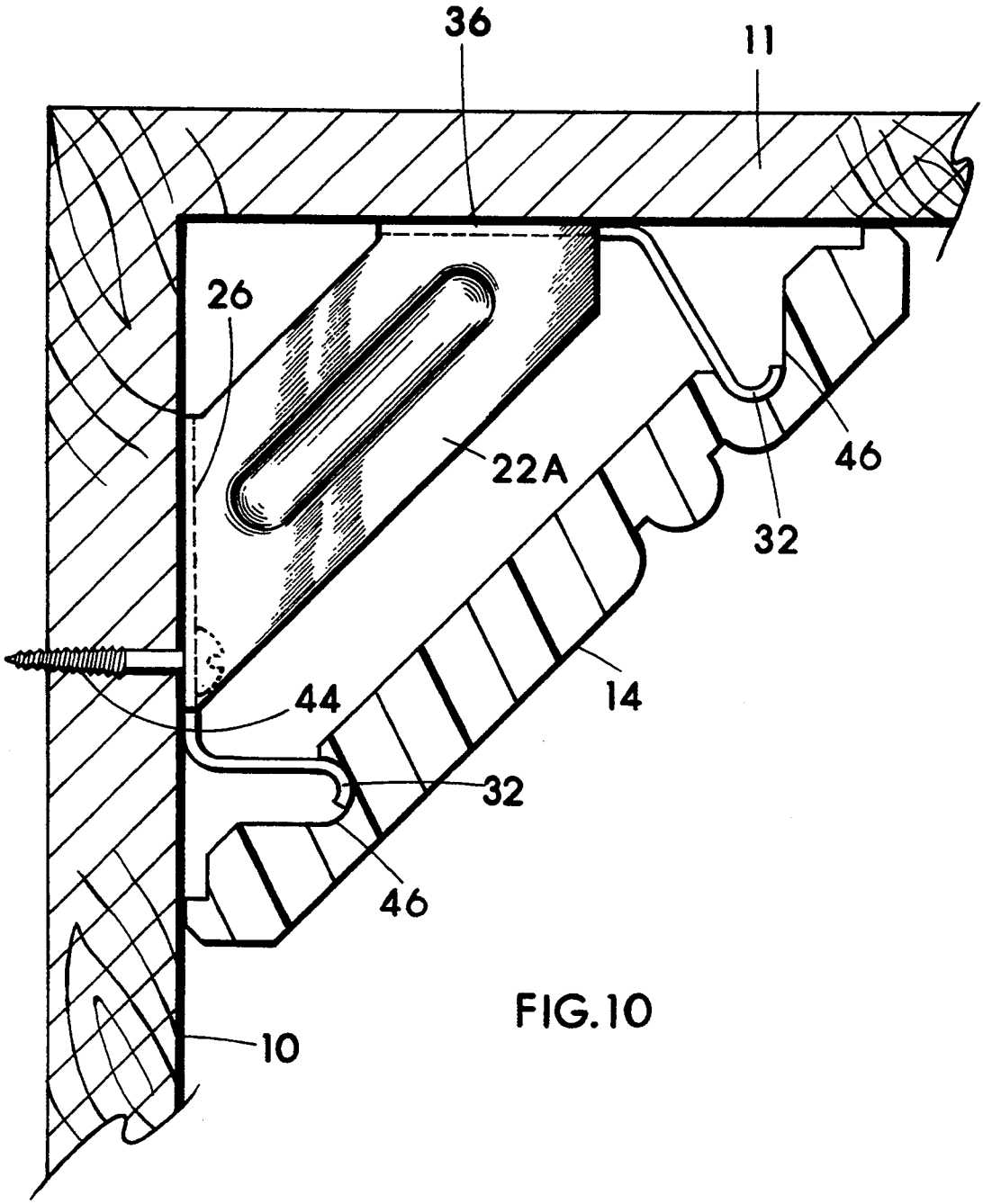
FIG. 10 is a sectional end view of an anticipated crown molding attached to a wail with a spring fixture.
Figure 11:
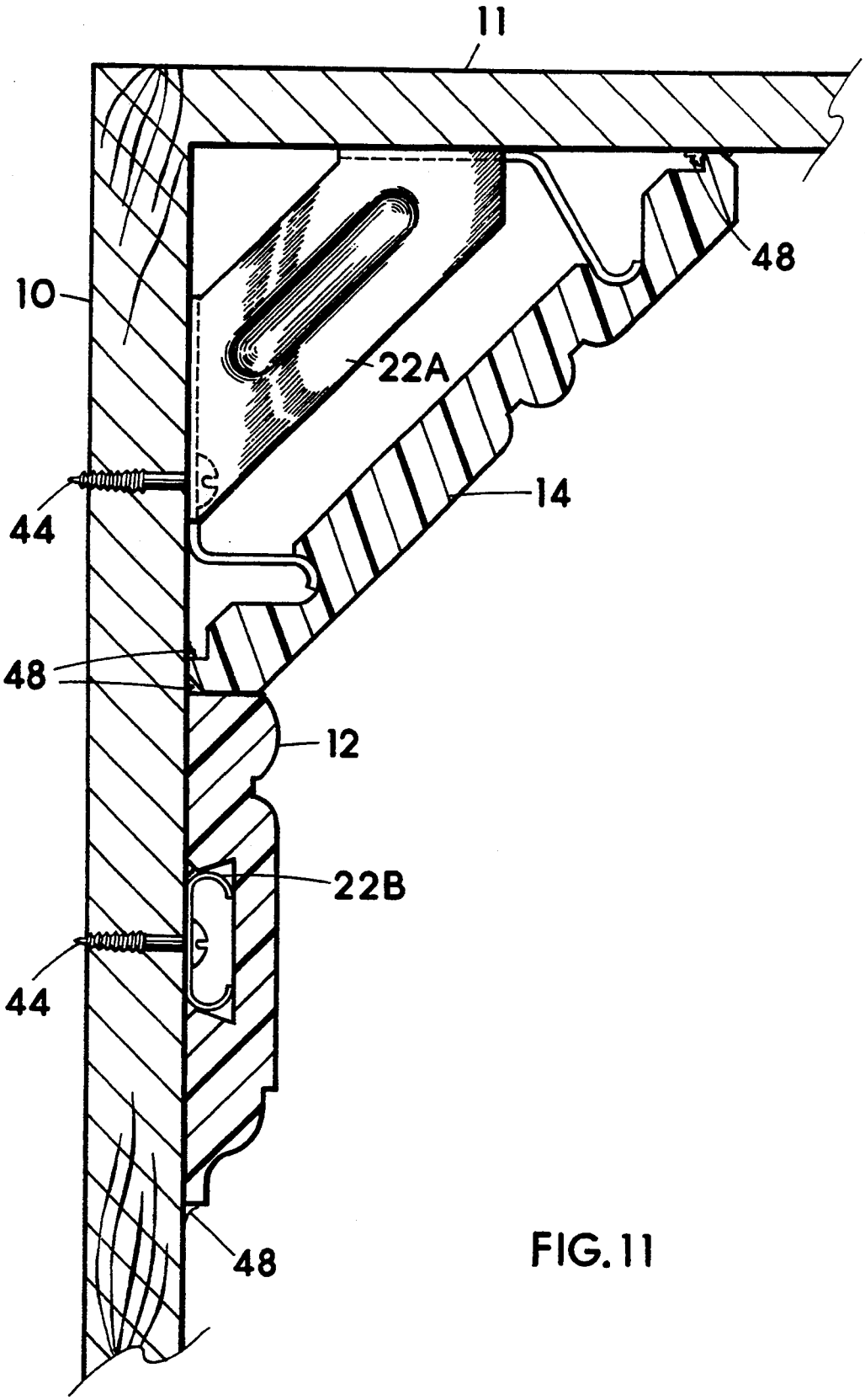
FIG. 11 is a sectional end view of an anticipated two piece crown molding attached with spring fixtures to the building.

Fixtures 22 A are primarily used with crown molding 14 of the immediate invention as shown in FIGS. 10 and 11. FIG. 11 additionally shows a two piece crown molding arrangement where a molding 12 having dovetail shaped groove 38 and attached in place with fixture 22 B has been abutted against the lower side edge of crown molding 14. FIG. 10 is a sectional end view of an anticipated crown molding 14 attached to wall 10 with a fixture 22 A. Crown molding 14 is decoratively sculptured on the exposed or front surface, and the oppositely disposed surface or back surface has two grooves 46. Grooves 46 extend continuously the full length of crown molding 14, and in parallel alignment with one another. As may be ascertained from FIG. 10, grooves 46 are shaped so as to extend somewhat inward or toward each other at the deepest point, this being a shape leaving an overhanging lip for tabs 32 to lock under as may best be ascertained by closely examining FIG. 10.

The spacing between two oppositely disposed tabs 32 is such that when a molding such as the back surface of crown molding 14 shown in FIG. 10 is pressed against a properly mounted fixture 22 A, the curved portions of tabs 32 abut the back surface of the molding 14 adjacent the groove 46. With continued pressure, the tabs 32 are bowed outward so as to snap into the grooves 46 where spring tension of the tabs 32 attempting to move back inward into a relaxed position apply sufficient pressure against the interior surfaces of grooves 46 to hold the molding 14 securely in place. All four tabs 32 of each fixture 22 A are locked within grooves 46 when properly installed. The crown molding 14 may be removed if desired by simply applying sufficient pulling pressure on molding 14 to defeat the holding pressure of tabs 32, although, again a prying device such as a pry bar or screw driver is usually needed to move the molding 14 away from the wall sufficiently to grasp the molding to remove it completely from the wall and fixtures 22 A. As shown in FIG. 10 and 11, fixtures 22 A are structured to be attached in a 90 degree corner, and to support crown molding 14 at about a 45 degree angle to the wall 10 or ceiling 11.

It should be noted fixture 22 A and 22 B are just examples of some suitable fixtures, as are grooves 38 and 46, and it is anticipated that a long strip-like fixture may be used as a mounting fixture for molding 12. The single elongated strip-like mounting fixture would require greater amounts of materials to manufacture, on the other hand, the additional cost of manufacturing may be off set by time saved in attaching long strip mounting fixtures as opposed to a plurality of individual fixtures which must be aligned in a straight line such as fixtures 22 A and 22 B.

As shown in FIG. 11, for areas known to have earthquakes, or for any reason where a more positive securement of crown molding 14, or any other moldings 12 of this disclosure for that matter, adhesives 48 may be used to permanently attach the moldings 12 to the finished walls 10 or ceiling 11 of the building. Where it is desirable to permanently attach the molding 12 to any part of the building, a suitable adhesive 48 such as construction adhesive or mastic is applied either to the building in the area where an abutment between the building member and a portion of the molding 12 will occur, or to a portion of the back surface of the molding 12. An elongated bead of adhesive 48 material may work best, and may be applied in a manner to additionally fill any cracks between an edge of a molding 12 and the wall or ceiling if desired. In the situation where moldings 12 are being glued to the building structure, fixtures 22 A and 22 B serve to retain the moldings 12 tightly against the building until the adhesive 48 has set, eliminating any need for props or other temporary means of securing the moldings 12 in place until the adhesive 48 has set.

All of the trim moldings 12 of this disclosure are manufactured of substantially rigid, non-foamed, non-laminated or coated solid thermoset polymer based material, essentially "Corian", "Fountainhead" or "Surell" solid surfacing material. This being to provide the material advantages of polymer based solid surfacing materials which were described earlier in this disclosure in a building trim molding 12.

Figure 12:
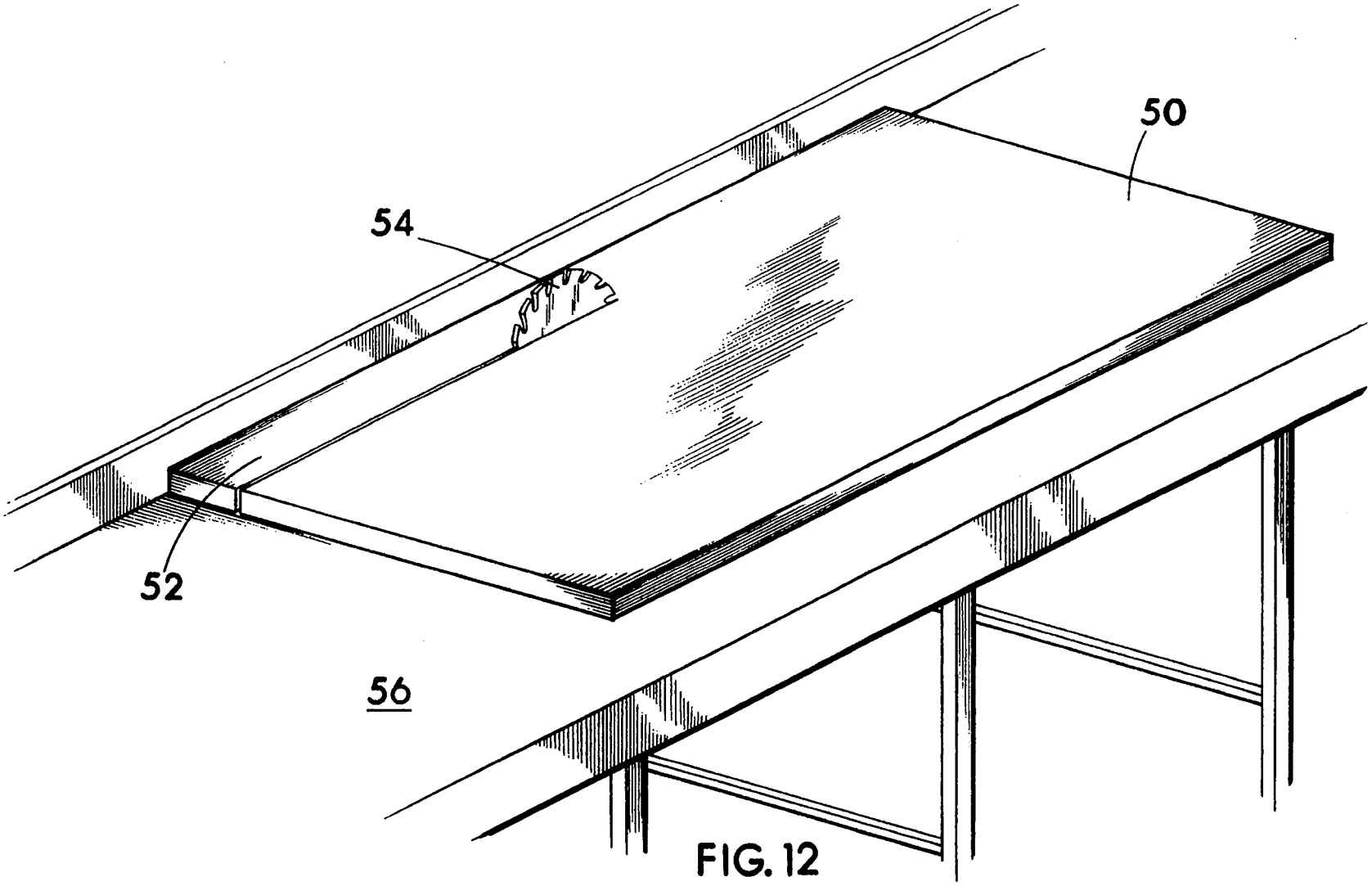
FIG. 12 is illustrative of a bulk sheet of thermoset polymer based solid surfacing material being sawn into strips with a table saw.
Figure 13:
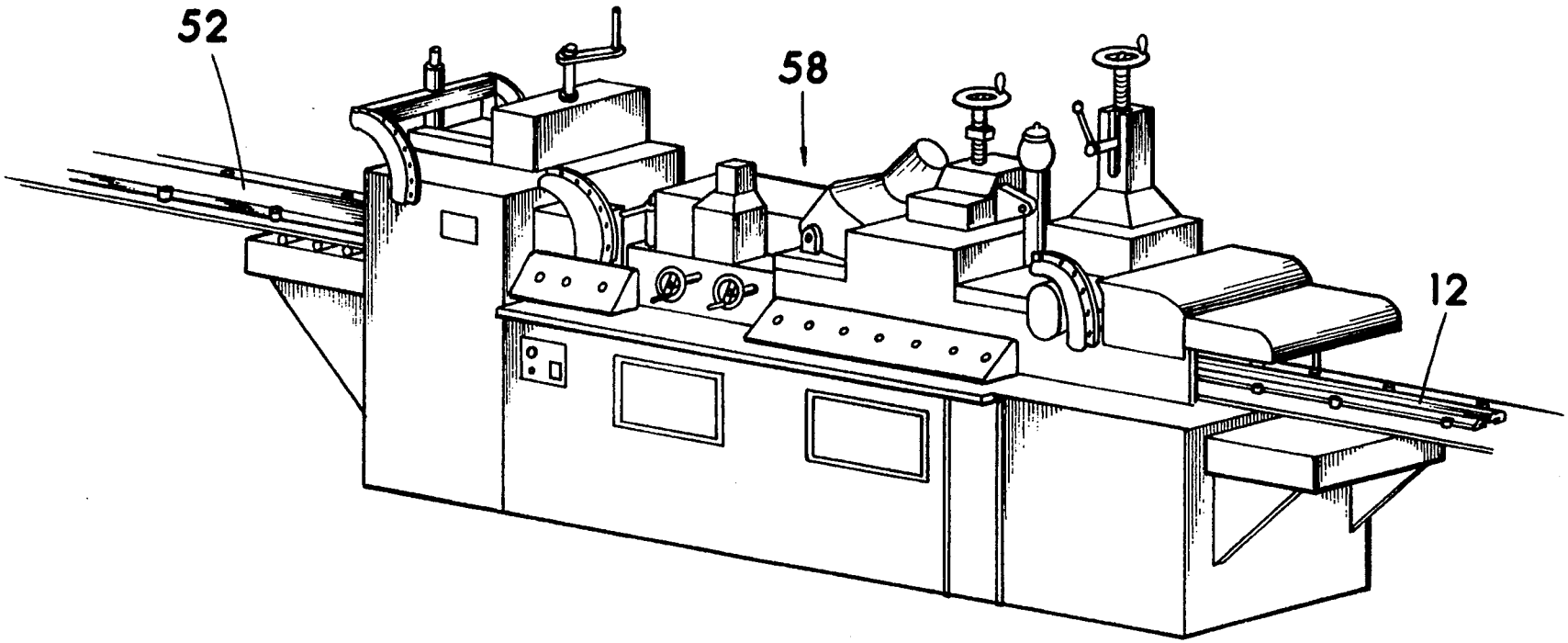
FIG. 13 is illustrative of a power shaping or molding machine shaping a strip of thermoset polymer based solid surfacing material into a suitable shape for use as a trim molding.
Figure 14:
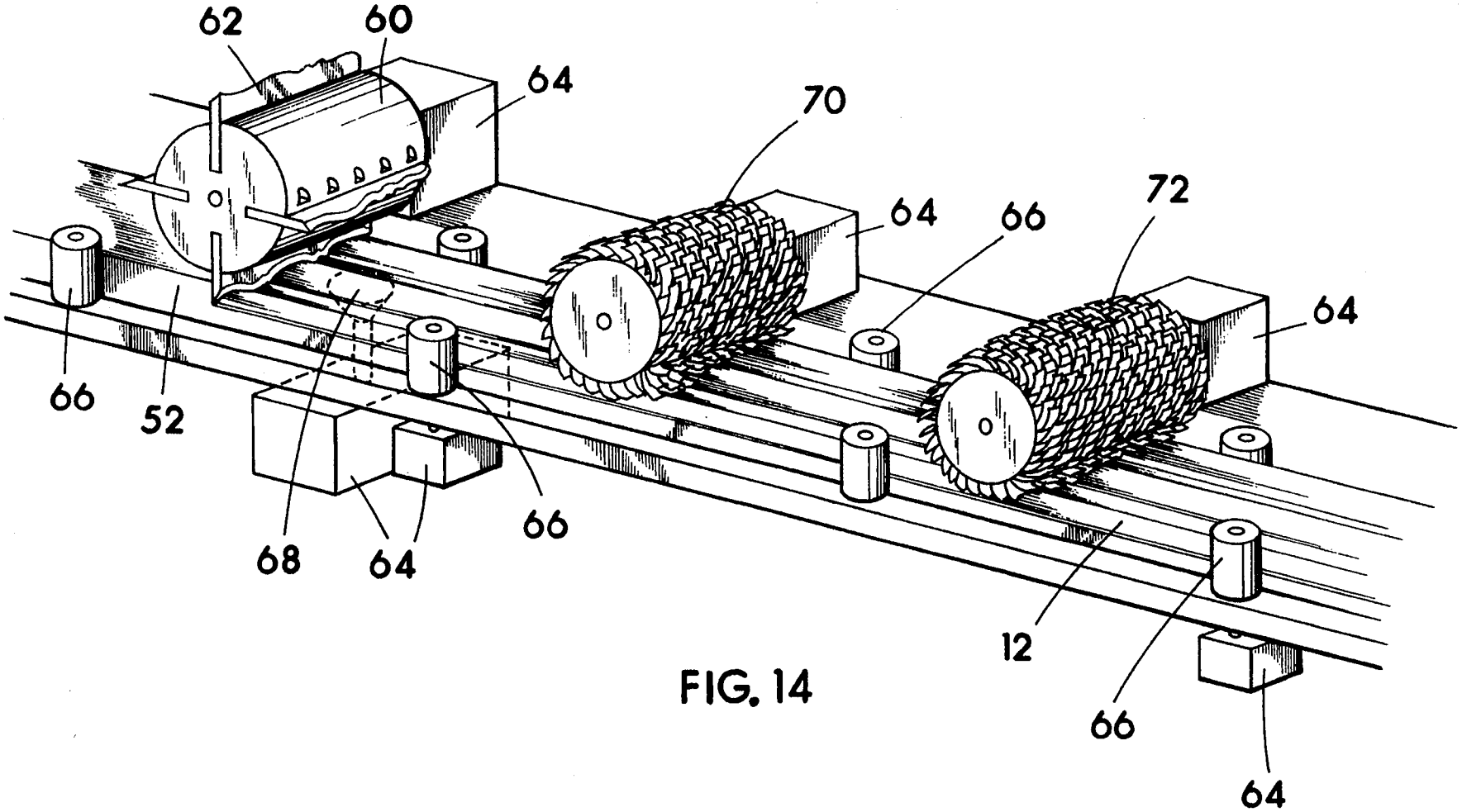
FIG. 14 is illustrative of one possible arrangement of the material removal planer head, cutters and sanders in the molding machine of FIG. 13.

The method of manufacturing of molding 12 which I propose is one which begins with bulk pieces of rigid thermoset polymer based material of the desired color or color pattern and texture, preferably in sheet form. The sheet 50 may then be cut into strip form. In FIG. 12, a sheet 50 of rigid thermoset polymer based material is shown being cut into a rectangular strip 52 by the blade 54 of a table saw 56. The elongated strip 52 may then be ran through a power molding machine 58 commonly known as a "molder" in the wood molding industry. FIG. 13 shows a molder 58 wherein the elongated strip 52 is being suitably shaped and finished into a molding 12. Shown in FIG. 14 is one possible suitable arrangement of the material removal and shaping mechanics within a molder 58. Shown is a strip 52 being guided by rollers 66, some rollers 66 may be rotary powered by motors 64 to assist in propelling the strip 52. Also powered by a motor 64 is a rotary molding head 60 having interchangeable cutting blades 62. Cutting blades 62 are shaped so as to cut the desired decorative sculpturing into the front surface of the strip 52, which is in the process of becoming a molding 12. Also powered by a motor 64 is a rotary dovetail shaped cutter or bit 68 shown in dotted lines under the strip 52. Cutter 68 is forming the dovetail shaped groove 38 in the back surface of what is becoming molding 12 at the same time the oppositely disposed front surface is be decoratively sculptured by blades 62. Blades 62 may also be shaped so as to be able to shape the sides of the strip 52. Two properly shaped and positioned cutting bits would be substituted for dovetail cutter 68 in order to form grooves 46 for crown molding 14. Although blades 62 when sharp are capable of cutting and leaving a fairly smooth and attractive finish, an improved finish may be obtained by the use of a relatively course sanding wheel 70 which has flexible sanding members to follow the contours of the now sculptured molding 12, and which may additionally be followed by a fine sanding or polishing wheel 72 which may also contain flexible sanding or polishing members to follow the contours of molding 12.

Although I have very specifically described the immediate invention, it will be apparent to those skilled in the art that many changes in the specific structures described and shown in the drawings may be made without departing from the scope of the invention, and therefore it should be understood that the scope of the invention is not to be overly limited by the specification and drawings given for example, but is to be determined by the broadest possible interpretation of the appended claims.

What I claim as my invention is:

1. In combination, an elongated substantially rigid architectural trim molding having the appearance of being made of natural stone, Said substantially rigid molding shaped by milling of substantially rigid non-laminated thermoset polymer based material having the appearance of natural stone so as to provide said substantially rigid molding with a sculptured decorative front surface and an oppositely disposed back surface with said back surface having an elongated generally dovetail shaped groove extending the full length of said substantially rigid molding, a narrower portion of said dovetail shaped groove being positioned near said back surface, and a wider portion of said dovetail shaped groove positioned more toward said front surface of said substantially rigid molding than said narrower portion of said dovetail shaped groove, a plurality of attachment fixtures affixed to a wall with said fixtures in straight-line alignment and in spaced relationship to one another, each of said fixtures including a rigid mounting base having extending and curved flexible spring biased tabs, each of said mounting bases having at least one elongated aperture with a fastener in said aperture attaching the fixture to said wall, each of said fixtures affixed to said wall with said mounting base against said wall and said curved flexible spring biased tabs extending outward away from said wall, said curved flexible spring biased tabs of said fixtures extending into said dovetail shaped groove of said substantially rigid molding with said back surface of said substantially rigid molding against said wall, each of said fixtures sized relative to said dovetail shaped groove so as to have said curved flexible spring biased tabs under constant tension within said dovetail shaped groove and applying constant outward pressure against the rigid material of said substantially rigid molding defining said dovetail shaped groove so as to hold and draw said substantially rigid molding securely against said wall, said substantially rigid molding sized relative to said fixtures so as to obscure from view said fixtures holding said substantially rigid molding, said substantially rigid molding being substantially and sufficiently rigid so as to require substantially all deflection which occurs during an initial placement of said curved flexible spring biased tabs into said dovetail shaped groove to occur in said curved flexible spring biased tabs of said fixtures.

2. A combination according to claim 1 wherein said substantially rigid molding is base molding at a joint between said wall and a floor.

3. A combination according to claim 1, wherein said substantially rigid molding is chair rail molding extending horizontally along said wall.

4. A combination according to claim 1, wherein said substantially rigid molding is crown molding at a joint between said wall and a ceiling.

5. A combination according to claim 1, wherein said substantially rigid molding is door casing attached to said wall.

6. An elongated substantially rigid architectural trim molding for a building, said rigid architectural trim molding shaped by milling of previously hardened substantially rigid plastics so as to render said rigid architectural trim molding with a sculptured decorative front surface and an oppositely disposed back surface with said back surface having at least one elongated groove extending the length of said rigid architectural trim molding; and a cooperative attachment means for attaching said rigid architectural trim molding to a wall, said attachment means including a plurality of attachment fixtures each structured to be cooperatively functional with said at least one elongated groove for attaching said rigid architectural trim molding to a wall, each of said fixtures including a mounting base having extending and curved flexible spring biased tabs, each of said mounting bases having at least one opening sized for partial passage of a fastener for attaching the mounting base to a wall with said curved flexible spring biased tabs extending outward away from the wall, said curved flexible spring biased tabs of said fixtures sized and shaped relative to said at least one elongated groove so as to allow for the insertion of said curved flexible spring biased tabs within said at least one elongated groove, said rigid architectural trim molding being substantially and sufficiently rigid so as to require substantially all deflection which occurs during an initial insertion of said curved flexible spring biased tabs into said at least one elongated groove to occur in said curved flexible spring biased tabs of said fixtures, said curved flexible spring biased tabs of said fixtures sized and positioned relative to said at least one elongated groove so as to have said curved flexible spring biased tabs under constant tension when within said at least one elongated groove and applying constant pressure against the rigid plastic of said rigid architectural trim molding so as to provide means for holding and drawing said rigid architectural trim molding toward said mounting base and thus toward and against a wall when said fixtures are attached to a wall, said rigid architectural trim molding sized relative to said fixtures so as to conceal said fixtures from view when holding said rigid architectural trim molding against a wall.

7. An architectural trim molding according to claim 6, wherein said rigid architectural trim molding is suitably sized and shaped for use as base molding installable at a joint between a wall and a floor.

8. An architectural trim molding according to claim 6, wherein said rigid architectural trim molding is suitably sized and shaped for use as chair rail molding installable horizontally along a wall.

9. An architectural trim molding according to claim 6, wherein said rigid architectural trim molding is suitably sized and shaped for use as crown molding installable at a joint between a wall and a ceiling.

10. An architectural trim molding according to claim 6, wherein said rigid architectural trim molding is suitably sized and shaped for use as door casing around a door.

* * * * *